US006138780A

United States Patent [19]

Beuershausen

[11] Patent Number: 6,138,780

[45] Date of Patent: Oct. 31, 2000

[54] DRAG BIT WITH STEEL SHANK AND TANDEM GAGE PADS

[75] Inventor: Christopher C. Beuershausen, Spring, Tex.

[73] Assignee: Baker Hughes Incorporated, Houston, Tex.

[21] Appl. No.: 09/132,106

[22] Filed: Aug. 11, 1998

Related U.S. Application Data

[63] Continuation-in-part of application No. 08/924,935, Sep. 8, 1997.

[51] Int. Cl.[7] ..... E21B 17/10

[52] U.S. Cl. ..... 175/408; 175/325.2; 175/425; 175/435

[58] Field of Search ..... 175/393, 406, 175/408, 425, 435, 325.2

[56] References Cited

U.S. PATENT DOCUMENTS

| | | | |
|---|---|---|---|
| 1,477,855 | 12/1923 | Thurston | 175/408 X |
| 1,873,814 | 8/1932 | Brewster | 175/392 |
| 2,071,604 | 2/1937 | Wright et al. | 175/392 |
| 2,794,617 | 6/1957 | Yancey | 175/323 |
| 3,322,218 | 5/1967 | Hildebrandt . | |
| 3,575,247 | 4/1971 | Feenstra . | |
| 3,820,611 | 6/1974 | King . | |
| 3,825,083 | 7/1974 | Flarity et al. | 175/394 |
| 3,851,719 | 12/1974 | Thompson et al. | 175/406 |
| 3,871,488 | 3/1975 | Sabre . | |
| 3,978,933 | 9/1976 | Olson et al. | 175/325 |
| 4,234,048 | 11/1980 | Rowley | 175/329 |
| 4,385,669 | 5/1983 | Knutsen . | |
| 4,515,227 | 5/1985 | Cerkovnik | 175/393 X |
| 4,869,330 | 9/1989 | Tibbitts . | |
| 4,941,538 | 7/1990 | King . | |
| 5,004,057 | 4/1991 | Tibbitts et al. . | |
| 5,163,524 | 11/1992 | Newton, Jr. et al. . | |
| 5,467,836 | 11/1995 | Grimes et al. . | |
| 5,558,170 | 9/1996 | Thigpen et al. . | |
| 5,839,525 | 11/1999 | Hoffmaster et al. | 175/375 |
| 5,904,213 | 5/1999 | Caraway et al. | 175/393 |
| 5,957,223 | 9/1999 | Doster et al. | 175/408 X |
| 6,006,845 | 12/1999 | Illerhaus et al. | 175/406 |

FOREIGN PATENT DOCUMENTS

| | | |
|---|---|---|
| 0-467-580-A1 | 1/1992 | European Pat. Off. . |
| 0-522-553-A1 | 1/1993 | European Pat. Off. . |
| 2-294-071 | 4/1996 | United Kingdom . |

*Primary Examiner*—Eileen D. Lillis
*Assistant Examiner*—Jong-Suk Lee
*Attorney, Agent, or Firm*—Felsman, Bradley, Vaden, Gunter & Dillon, L.L.P.; James E. Bradley

[57] ABSTRACT

A rotary earth-boring drag bit assembly has a bit body formed of a carbide matrix material. The body has a longitudinal axis and a face on a lower end containing cutters for engaging and cutting a bottom of the borehole. The cutters are carried on fixed blades extending about and radially outwardly of the face. A steel threaded pin member is bonded to an upper end of the body. A steel shank having a threaded receptacle on a lower end secures to the threaded pin member. The steel shank has a threaded pin on an upper end that secures to a drill string. A lower set of gage pads is disposed about a periphery of the body and extends longitudinally away from the face for engaging a sidewall of the borehole. Each of the gage pads is contiguous with and extends from one of the blades. The gage pads are elongated in an axial direction and protrude from the periphery. Slots are located between the gage pads for the flow of drilling fluid and cuttings. An upper set of gage pads is disposed about and protrudes from the shank. The upper set of gage pads is spaced longitudinally from and rotationally offset from the lower set of gage pads. The upper set of gage pads is elongated in an axial direction and circumferentially spaced apart from each other. Slots are located between the upper set of gage pads for the flow of drilling fluid and cuttings.

16 Claims, 2 Drawing Sheets

DRAG BIT WITH STEEL SHANK AND TANDEM GAGE PADS

CROSS-REFERENCE TO RELATED APPLICATION

This application is a continuation-in-part of the application entitled Rotary Drill Bits Employing Tandem Gag e Pad Arrangement, filed Sep. 8, 1997, Ser. No. 08/924,935.

TECHNICAL FIELD

This invention relates in general to fixed cutter or drag bits for well drilling, and in particular to a bit employing tandem gage pads to provide enhanced stability of the bit for directional drilling.

BACKGROUND ART

Rotary well drilling for oil and gas is primarily accomplished through one of two types of bits. In a rotary cutter bit, the bit body has typically three rotatable cones or cutters. The cones rotate on bearing pins and have teeth or tungsten carbide inserts for disintegrating the earth formation. In the fixed cutter or drag bit type, the bit body has a face which contains cutting elements mounted on fixed blades. The cutting elements are typically polycrystalline diamond. The bit body has drilling fluid passages with nozzles for discharging drilling fluid through junk slots that are located between the blades.

Drag bits are extensively used in directionally drilling, particularly in the technique referred to as steerable drilling. In this method, the drill bit is steered in desired directions for cutting borehole segments as it progresses. A mud motor or turbine is employed with the bit assembly for rotating the drag bit while the drill string remains stationary.

In the prior art, drag bits used for steerable drilling have employed relatively short gage lengths, often even shorter than gage lengths for conventional bits not used for steerable applications. The gage length is a portion of the bit body that extends upward from the face and has an effective diameter approximately equal to the diameter of the borehole being cut. On the other hand, the parent application to this application explains that short gage bits also produce an increased amount of borehole irregularities, such as side wall ledging, spiraling of the borehole and rifling of the borehole sidewall. Excessive side cutting of a bit may lead to ledging of a severity such that downhole tools may actually become stuck while travelling through the borehole.

The parent application teaches to provide a longer gage length with tandem gage pads along the gage surface of the bit body. In the parent application, the gage pads are shown to be integrally formed with the bit body. Drag bit bodies of this nature are typically formed of a carbide matrix, such as tungsten carbide. While tungsten carbide works well for drag bit bodies generally, problems may occur if the bit body is lengthened to accommodate tandem gage pads. Tungsten carbide does not withstand excessive bending loads well, thus cracking may tend to occur in the body under extreme loading conditions.

SUMMARY OF INVENTION

In this invention, the bit body is formed of a conventional carbide matrix material. The body has a longitudinal axis and a face which contains a plurality of cutters mounted to fixed blades for cutting the bottom of the borehole. A first set of circumferentially spaced gage pads are disposed about a periphery of the bit body and extend longitudinally away from the bit face.

A steel shank is secured to the bit body, the shank having a threaded pin on an opposite end from the body which is secured to a drill string. A second set of circumferentially spaced gage pads are located on the steel shank.

The shank and the body are connected together by a threaded coupling as well as being welded. The secondary set of gage pads are preferably rotationally offset from the primary set of gage pads and are longitudinally spaced from them. The primary gage pads comprise longitudinal extensions of the blades located on the face of the bit body. The first and second gage pads have outer surfaces which are smooth and free of any cutting structure.

BEST MODE FOR CARRYING OUT THE INVENTION

Figure 1:
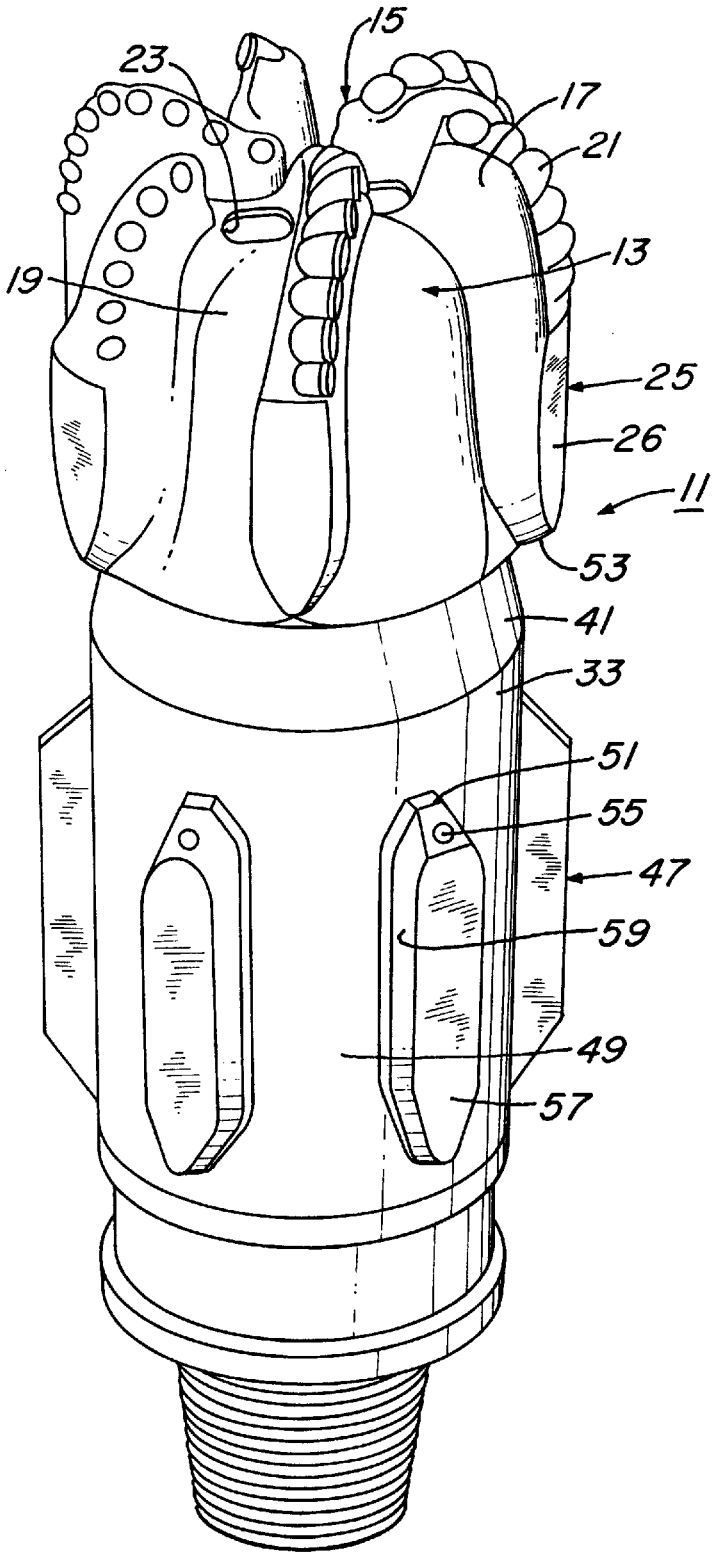
FIG. 1 is a perspective view showing a drag bit assembly constructed in accordance with this invention.

Referring to FIG. 1, bit assembly 11 has a body 13 on a lower end. Body 13 has a face 15 on its lower end. A plurality of blades 17 are formed on and protrude from face 15, with six blades 17 being shown in the drawings. Blades 17 lead outward from a central portion of face 15 to a gage area at the periphery of body 13. Blades 17 are separated from each other, defining junk slots 19 between them for the passage of drilling fluid and cuttings. Each blade 17 contains a row of conventional cutters typically polycrystalline diamond (PCD). Nozzles 23 discharge drilling fluid, which flows through junk slots 19 and back up the borehole along with the cuttings.

A set of primary gage pads 25 is integrally formed on the sides of bit body 13. Each primary gage pad 25 is contiguous with and, in the embodiment shown, extends longitudinally from one of the blades 17. Alternately, primary gage pads 25 could be inclined relative to the axis or curved in a spiral. Each primary gage pad 25 protrudes from body 13, extending the junk slots 19. Primary gage pads 25 are dimensioned to have an outer surface 26 at the gage or diameter of the borehole being cut. Outer surface 26 contains wear resistant surfaces, but is smooth and free of any cutting structure. Bit body 13, along with blades 17 and gage pads 25, is formed of a carbide matrix in a conventional casting process. Preferably, the material of body 13 is tungsten carbide.

Figure 2:
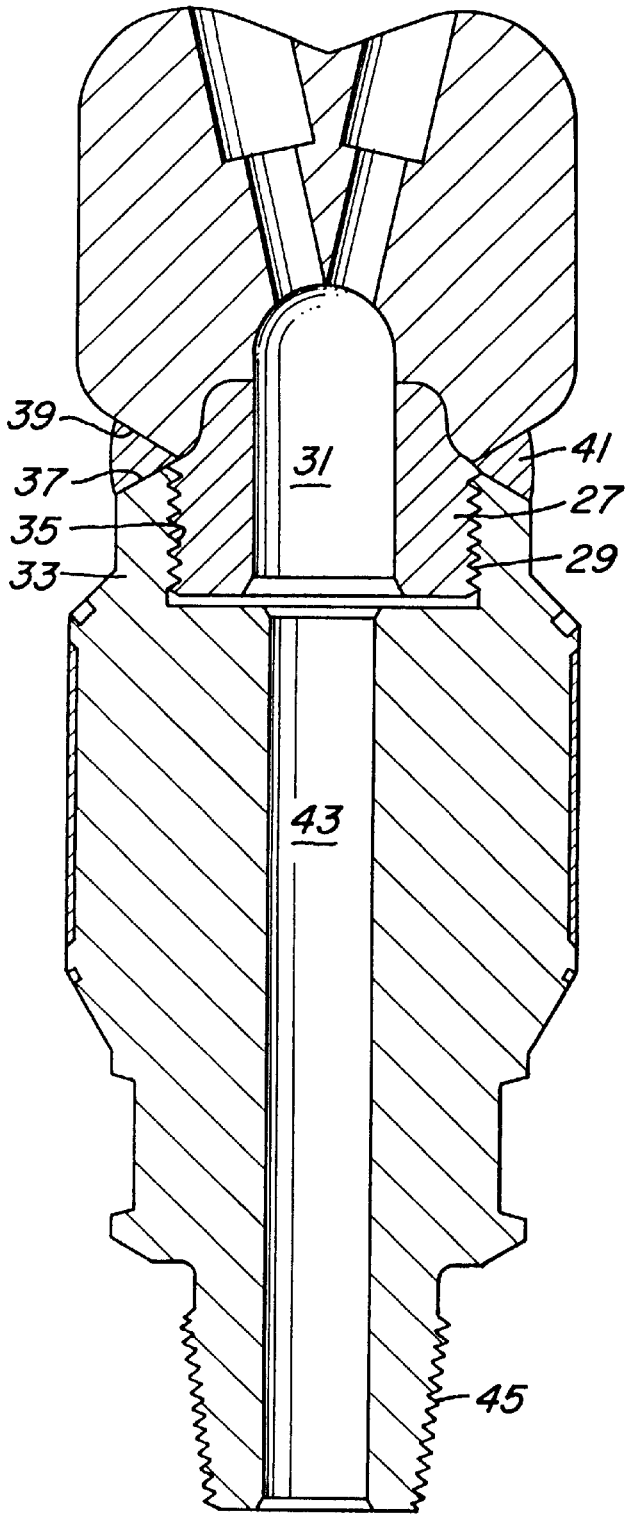
FIG. 2 is a vertical sectional view of the drag bit assembly of FIG. 1.

Referring to FIG. 2, a steel threaded coupling or blank 27 is joined to an upper end of body 13. Blank 27 is bonded to body 13 during the casting process. Blank 27 protrudes from the upper end of body 13 and has threads 29 on its exterior. An axial passage 31 extends through blank 27 and joins nozzles 23 for delivering drilling fluid.

A shank 33 is secured to blank 27. Shank 33 is also formed of steel, rather than of a carbide matrix. Shank 33 is a cylindrical member that may have a length longer than the axial dimension of body 13. Shank 33 has a threaded receptacle 35 which engages threads 29 of blank 27. A chamfer or bevel 37 is formed on the lower end of shank 33. Similarly, a bevel 39 is formed on the upper end of body 13. The opposed bevels 37, 39 create a V-shaped annular cavity. This cavity is filled with a weld material 41, the welding permanently joining shank 33 to bit body 13. Shank 33 has an axial passage 43 which registers with passage 31 for delivering drilling fluid. Shank 33 has a threaded pin 45 on its upper end. Pin 45 is dimensioned for securing to a lower end of a drill string.

Referring again to FIG. 1, a plurality of secondary gage pads 47 are formed on the exterior of shank 33, such as by machining. Secondary gage pads 47 comprise elongated protruding members which define junk slots 49 between them. Preferably, there is an equal number of secondary gage pads 47 to primary gage pads 25. However, secondary gage pads 47 are preferably rotationally offset or staggered relative to primary gage pads 25. Each primary gage pad 25 will register or align with one of the junk slots 49. There is an annular longitudinal space between the lower ends 51 of the secondary gage pads 47 and the upper ends 53 of the primary gage pads 25. The upper ends of the primary gage pads 53 terminate substantially at the upper end of bit body 13. Lower ends 51 of secondary gage pads 47 terminate a short distance above weld 41. Lower ends 51 of secondary gage pads 47 are tapered. Similarly, upper ends 53 of primary gage pads 25 are tapered. The widths of gage pads 47 and 25 are substantially the same and considerably less than the lengths, making pads 47, 25 elongated in an axial direction. The lengths of secondary gage pads 47 can be the same as or longer than primary gage pads 25. In the embodiment shown, secondary gage pads 47 are parallel to the axis and to primary gage pads 25. Alternately, secondary gage pads 47 could be inclined relative to the axis or curved in a spiral.

Lower ends 51 of secondary gage pads 47 have either a hardfacing or a wear-resistant insert 55 or a combination of both. Hardfacing is also located on the outer surfaces 57 and leading and trailing edges 59 of secondary gage pads 47. Outer surfaces 57 are smooth and free of any cutting structure in the same manner as outer surfaces 26 of primary gage pads 25. The effective diameter of secondary gage pads 47 is slightly less than the borehole and thus the diameter of primary gage pads 47. Preferably the radius from each outer surface 57 to the axis is about 1/32 inch less than the radius from each outer surface 26 to the axis.

Bit assembly 11 will operate in a manner that is conventional with other steerable drag bit assemblies. It will normally be secured to a turbine or mud motor which is at the lower end of drill string. Drilling fluid pumped down the drill string drives the mud motor, which in turn causes rotation of bit 11. The spaced apart tandem gage pads 25, 47 stabilize bit 11 to condition the borehole wall, preventing ledging and other irregularities.

The invention has significant advantages. The steel shank for supporting the secondary gage pads is better able to accommodate bending forces than the tungsten carbide bit body, thus resisting the tendency of the bit assembly to fracture between the primary and secondary gage pads.

While the invention has been shown in only one of its forms, it should be apparent to those skilled in the art that it is not so limited but susceptible to various changes without departing from the scope of the invention.

I claim:

1. A rotary earth-boring drag bit assembly, comprising:

a bit body formed of a carbide matrix material, the body having a longitudinal axis and a face containing a plurality of cutters for engaging and cutting a bottom of the borehole;

a steel shank rigidly secured to the body, the shank having a threaded pin which is adapted to be secured to a drill string;

a plurality of circumferentially-spaced first gage pads disposed about a periphery of the body and extending longitudinally away from the face, the first gage pads protruding from the body and being circumferentially spaced from each other, defining a plurality of first slots between them for the passage of drilling fluid and cuttings;

a plurality of circumferentially-spaced second gage pads integrally formed on the shank, the second gage pads protruding from the shank and being circumferentially spaced from each other, defining a plurality of second slots between them for the passage of drilling fluid and cuttings;

the first gage pads having upper ends offset and spaced rotationally from lower ends of the second gage pads; and wherein the first and second gage lads have wear resistant outer surfaces that are substantially smooth and free of any cutting structure.

2. The bit according to claim 1, wherein the shank and the body are welded to each other.

3. The bit according to claim 1, wherein the material of the body is tungsten carbide.

4. The bit according to claim 1, wherein the first and second gage pads are longitudinally spaced from each other, defining an annular space between the upper ends of the first gage pads and the lower ends of the second gage pads.

5. The bit according to claim 1, wherein at least some of the cutters are carried on blades extending about and radially outwardly of the face.

6. The bit according to claim 5, wherein the first gage pads comprise extensions of the blades.

7. A rotary earth-boring drag bit assembly, comprising:

a bit body formed of a carbide matrix material, the body having a longitudinal axis and a face containing a plurality of cutters for engaging and cutting a bottom of the borehole;

a first threaded member bonded to an upper end of the body opposite the face;

a steel shank having a second threaded member on one end which secures to the first threaded member, the steel shank having a threaded pin on an opposite end from the second threaded member which is adapted to be secured to a drill string;

a first set of gage pads disposed about a periphery of the body and extending longitudinally away from the face for engaging a sidewall of the borehole, the first set of gage pads being elongated in an axial direction and circumferentially spaced apart from each other, defining a plurality of first slots for the flow of drilling fluid and cuttings, the first set of gage pads having upper ends at the upper end of the body;

a second set of gage pads integrally formed on the shank and extending longitudinally along the shank for stabilizing the bit assembly in the borehole, the second set of gage pads being elongated in an axial direction and circumferentially spaced apart from each other, defining a plurality of second slots from the flow of drilling fluid and cuttings, the second set of gage pads has lower ends spaced above the lower end of the shank; and wherein the first and second sets of gage pads have wear resistant outer surface that are substantially smooth and free of any cutting structure.

8. The bit according to claim 7, further comprising:

a chamfer formed on the body surrounding the threaded member of the body;

a mating chamfer formed on the shank on said one end, defining a generally V-shaped cavity; and a weld filling the cavity and joining the shank to the body.

9. The bit according to claim 7, wherein the first threaded member is externally threaded and the second threaded member is internally threaded.

10. The bit according to claim 7, wherein the second set of gage pads is rotationally offset from the first set of gage pads.

11. The bit according to claim 7, wherein the material of the body is tungsten carbide.

12. The bit according to claim 7, wherein the first and second sets of gage pads are longitudinally spaced from each other, defining an annular space between the upper ends of the first set of gage pads and the lower ends of the second set of gage pads.

13. The bit according to claim 7, wherein at least some of the cutters are carried on blades extending about and radially outwardly of the face; and wherein the first set of gage pads comprises extensions of the blades.

14. A rotary earth-boring drag bit assembly, comprising:

a bit body formed of a carbide matrix material, the body having a longitudinal axis and a face on a lower end containing a plurality of cutters for engaging and cutting a bottom of the borehole, at least some of the cutters being carried on fixed blades extending about and radially outwardly of the face;

a steel threaded pin member bonded to an upper end of the body;

a steel shank having a threaded receptacle on a lower end which secures to the threaded pin member, the steel shank having a threaded pin on an upper end which is adapted to be secured to a drill string;

a lower set of gage pads disposed about a periphery of the body and extending longitudinally away from the face for engaging a sidewall of the borehole, each of the gage pads being contiguous with and extending from one of the blades, the gage pads being elongated in an axial direction and protruding from the periphery, defining a plurality of first slots between them for the flow of drilling fluid and cuttings, the lower set of gage lads having upper ends at the upper end of the body;

an upper set of gage pads integrally formed on and protruding from the shank, the upper set of gage pads having lower ends that are above the lower end of the shank and above the upper ends of the lower set of gage pads, defining an annular space between the first and second sets of gage pads, the upper set of gage pads being rotationally offset from the lower set of gage pads, the upper set of gage pads being elongated in an axial direction and circumferentially spaced apart from each other, defining a plurality of second slots between them for the flow of drilling fluid and cuttings; and wherein the first and second sets of gage pads have wear resistant outer surface that are substantially smooth and free of any cutting structure.

15. The bit according to claim 14, further comprising:

a chamfer formed on the body surrounding the threaded member of the body between the upper ends of the lower set of gage pads and the lower ends of the upper set of gage pads;

a mating chamfer formed on the steel shank on said one end, defining a generally V-shaped cavity; and a weld filling the cavity and joining the shank to the body.

16. The bit according to claim 14, wherein the material of the body is tungsten carbide.

* * * * *

UNITED STATES PATENT AND TRADEMARK OFFICE

CERTIFICATE OF CORRECTION

PATENT NO. : 6,138,780
DATED : Oct. 31, 2000
INVENTOR(S) : Christopher C. Beuershausen It is certified that error appears in the above-identified patent and that said Letters Patent is hereby corrected as shown below:

Column 5, Line 14, please delete "comprises" and insert --comprise--.

Column 6, Line 5, please delete "lads" and insert --pads--.

Column 6, Line 19, please delete "surface" and insert --surfaces--.

Signed and Sealed this

Eighth Day of May, 2001

*Attest:*

Nicholas P. Godici

NICHOLAS P. GODICI

*Attesting Officer*

*Acting Director of the United States Patent and Trademark Office*